US009241529B1

(12) United States Patent
Danelski

(10) Patent No.: US 9,241,529 B1
(45) Date of Patent: Jan. 26, 2016

(54) AIR-COOLED HARD HAT

(71) Applicant: Innovative Design Concepts, LLC, Ixonia, WI (US)

(72) Inventor: Darin L. Danelski, Oconomowoc, WI (US)

( * ) Notice: Subject to any disclaimer, the term of this patent is extended or adjusted under 35 U.S.C. 154(b) by 0 days.

(21) Appl. No.: 14/224,455

(22) Filed: Mar. 25, 2014

(51) Int. Cl.
*A42B 3/28* (2006.01)

(52) U.S. Cl.
CPC ..... *A42B 3/286* (2013.01)

(58) Field of Classification Search
CPC ..... A42B 3/286; A42B 3/285; A42B 3/28; A42B 3/281; A42B 3/283; A42B 3/288; A42B 1/24; A42B 1/008; A42C 5/04
USPC ..... 2/171.3, 7, 8, 422, 5, 6.6
See application file for complete search history.

(56) References Cited

U.S. PATENT DOCUMENTS

| | | | | | |
|---|---|---|---|---|---|
| 432,728 | A * | 7/1890 | Eliel | A42B 3/286 | 2/171.3 |
| 935,556 | A * | 9/1909 | Smith | 2/171.4 | |
| 1,774,074 | A * | 8/1930 | Wittcoff | 2/171.7 | |
| 3,168,748 | A * | 2/1965 | Limberg | 2/171.3 | |
| 3,353,191 | A * | 11/1967 | Dahly | A42B 1/008 | 136/206 |
| 3,391,407 | A | 7/1968 | Waters | | |
| 3,548,415 | A | 12/1970 | Waters | | |
| 3,813,696 | A | 6/1974 | Yeager | | |
| 3,881,198 | A | 5/1975 | Waters | | |
| 4,141,083 | A | 2/1979 | Waters | | |
| D275,334 | S | 9/1984 | Pullin | | |
| 4,680,815 | A * | 7/1987 | Hirsch et al. | 2/171.3 | |
| 4,893,356 | A * | 1/1990 | Waters | 2/171.3 | |
| 5,561,862 | A | 10/1996 | Flores, Sr. | | |
| 6,122,773 | A | 9/2000 | Katz | | |
| 6,760,925 | B1 | 7/2004 | Maxwell | | |
| 7,114,194 | B2 | 10/2006 | English | | |
| 7,331,064 | B1 * | 2/2008 | Quintal | 2/209.13 | |
| 7,921,473 | B1 | 4/2011 | Winters | | |
| 2007/0061946 | A1 * | 3/2007 | Webb | 2/410 | |
| 2008/0295220 | A1 | 12/2008 | Webb | | |
| 2009/0255025 | A1 | 10/2009 | Ochoa | | |
| 2012/0167282 | A1 | 7/2012 | Fleming et al. | | |
| 2013/0263364 | A1 | 10/2013 | Green | | |

FOREIGN PATENT DOCUMENTS

| | | | | |
|---|---|---|---|---|
| GB | WO 2009064555 A1 * | 5/2009 | | A42B 3/286 |
| WO | 2010075391 | 7/2010 | | |

* cited by examiner

*Primary Examiner* — Amy Vanatta
(74) *Attorney, Agent, or Firm* — Boyle Fredrickson, S.C.

(57) ABSTRACT

An air-cooled hard hat includes a hard hat and a fan arrangement. The fan arrangement has a fan, an input, and at least one outlet for distribution of air. An opening is made on the hard hat, which the at least one outlet feeds through. The opening may be located on the front face of a laterally facing wall of the hard hat. When the fan arrangement is attached to the hard hat, the outlet provides air to the interior of the hard hat through the hole. Additionally, another opening may be located along a front brim of the hard hat. A second outlet that feeds through the opening in the brim provides air down onto the face of the user.

20 Claims, 18 Drawing Sheets

AIR-COOLED HARD HAT

BACKGROUND OF THE INVENTION

1. Field of the Invention

The present invention relates in general to the field of hard hats. More particularly, the present invention relates to a fan arrangement cooling device that can be installed on a standard, traditional hard hat with little modification of the hard hat.

2. Discussion of the Related Art

It is well known that construction projects often involve work during hot conditions. Nevertheless, workers are normally required to wear appropriate safety gear including hard hats at all times when on a job site. As a result, a variety of different products have been introduced to help ensure an increased level of comfort in warm temperatures.

For instance, there are a number of specially made hard hats that include various cooling devices and fans within these configurations. One such configuration features a specially designed hard hat having a removable temperature panel that slides out such that a cooling pack or heating pack can be inserted into the crown of the hard hat. Other hard hats have extended portions in the rear of the hard hat that create a wind tunnel. Still other options provide blowers that attach to the rear of a hard hat to blow air up from under the rear rim of the hard hat.

Another option is hard hat configurations with additional devices mounted to the top of the hard hat, such that air is blown directly downward onto the scalp of the user. These configurations often require a specialized hard hat with additional space above the user's head to allow the necessary clearance. While providing increased air movement and comfort to the user, mans' of these options are heavy or bulky headgear which may be distracting or uncomfortable for a user accustomed to a standard hard hat. Additionally, many of these options require a specialized hard hat that must be specially manufactured.

What is needed, therefore, is a cooling device for use with a hard hat that is both light weight and easily adaptable to an existing hard hat, such that a user can have a cooling feature without having to purchase a specially made hard hat and without sacrificing the safety and comfort of a traditional hard hat.

SUMMARY OF THE INVENTION

By way of summary, the present invention is a cooling device for a hard hat, wherein a fan arrangement is mounted onto the front of a hard hat with minimal modifications to the structure of the hard hat.

In accordance with a first aspect of the invention, the fan arrangement can be mounted onto a standard hard hat that a user may already possess. The fan arrangement may be mounted to the hard hat through an opening in the shell of the hard hat. The fan arrangement includes a fan housing, an intake, and at least one outlet. The fan outlet can extend through the opening in the shell of the hard hat. The fan arrangement may also contain a power supply. In an alternative embodiment, a power supply may be provided outside of the fan arrangement.

In one embodiment of the invention, the opening is located in the front laterally facing side portion of the hard hat. In this configuration, the fan arrangement can be mounted directly above a brim located below the laterally facing side portion on the front of the hard hat. This results in the outlet being directed through the front laterally facing side portion of the hard hat into the interior of that hard hat.

In another embodiment of the invention, the fan arrangement may have a second outlet. The second outlet can extend through a second opening in the shell of the hard hat. For instance, the second opening may be located between the brim of the hard hat and the laterally facing side portion of the hard hat. This arrangement allows air movement both to the interior of the hard hat through the first opening, and to the user's face through the second opening. In such a two outlet configuration, the fan arrangement may contain a diverter that allows the user to control the amount of air directed to each of the two outlets.

In accordance with a second aspect of the invention, a method for providing an air circulation feature to a hard hat is provided. First, an opening is formed on one of the laterally facing external sides of the hard hat. Next, a fan arrangement is secured to the shell of the hard hat. The fan arrangement includes an intake and at least one outlet. To secure the fan arrangement, the outlet is positioned so as to extend through the opening and the intake remains outside of the shell. This allows for air movement into the inlet, through the fan arrangement, and out of the outlet and into the interior of that hard hat. In one embodiment, the fan arrangement is secured above the brim of the hard hat.

In another embodiment, a second opening may be formed near or at the intersection of the brim of the hard hat and the laterally facing exterior side portion. In this embodiment, the fan arrangement has a second outlet that can be secured within the second opening to provide air to the user's face. A diverter may be used to control the amount of air that is provided to the first outlet and the second outlet. The fan arrangement may be powered by an interior power source. Alternatively, a stand-alone power source may also be attached to the hard hat and connected to the fan arrangement.

These and other features and aspects of the present invention will be better appreciated and understood when considered in conjunction with the following description and the accompanying drawings It should be understood, however, that the following description, while indicating a representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
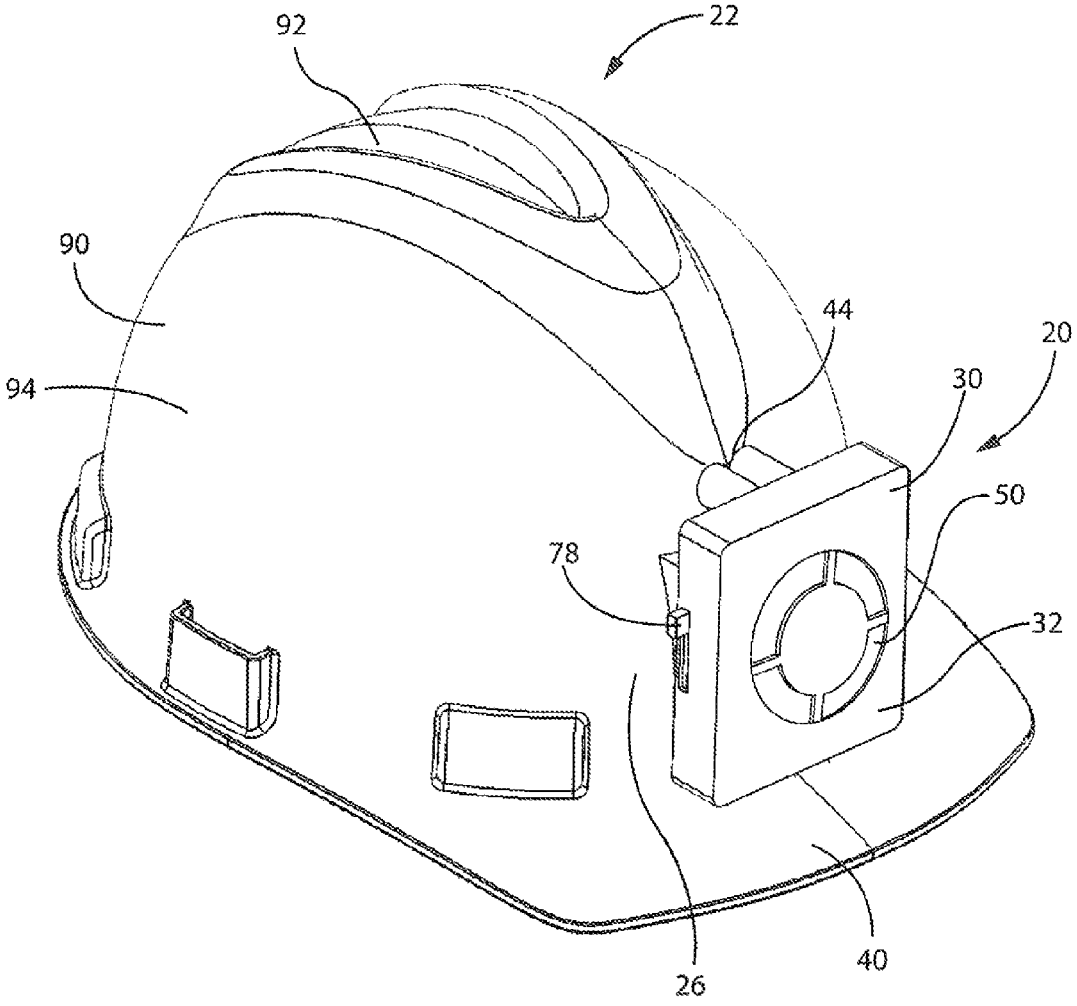
FIG. 1 is a top, side perspective view of a fan arrangement with multiple outlets installed on a hard hit in accordance with a first embodiment of the present invention.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION

Specific embodiments of the present invention will be described by the following non-limiting examples which will serve to illustrate various features of the invention. With reference to the drawing figures in which like reference numerals designate like parts throughout the disclosure, a representative embodiment of the present invention is a fan arrangement 20 that allows for increased air movement throughout a hard hat 22 to cool the user's head.

Initially, a hard hat 22 is provided to protect a user's head. The hard hat 22 has an outer shell 90 that connects to a harness. The outer shell 90 has a rounded top region 92 that extends downward to laterally facing side portions 94. On the front face 26 of the hard hat 22 is a brim 40 that extends away from the rounded top region 92 of the hard hat 22. The harness includes a head band 24 connected to a series of straps 25. The head band 24 of the hard hat 22 is connected to a series of straps 25 that contact the user's head. The head band 24 connects to the hard hat 22 and is adjustable such that the head hand 24 fits snugly around the user's head. The straps 25 extend from one side of the headband 24 to another, and extend towards the interior of the hard hat 22 when the straps 25 contact the user's head. These straps 25 allow the hard hat 22 to be suspended from the user's head such that the outer shell 90 is spaced away from direct contact with the user's head, creating a crown portion 42 of the hard hat 22. This space that is created between the user's head and the outer shell 90 by the harness allows distribution of any forces acting upon the outer shell 90 of the hard hat 22 to the headband 24 and straps 25. This reduces the risk of head injury due to forces to the head, such as dropped items.

Figure 2:
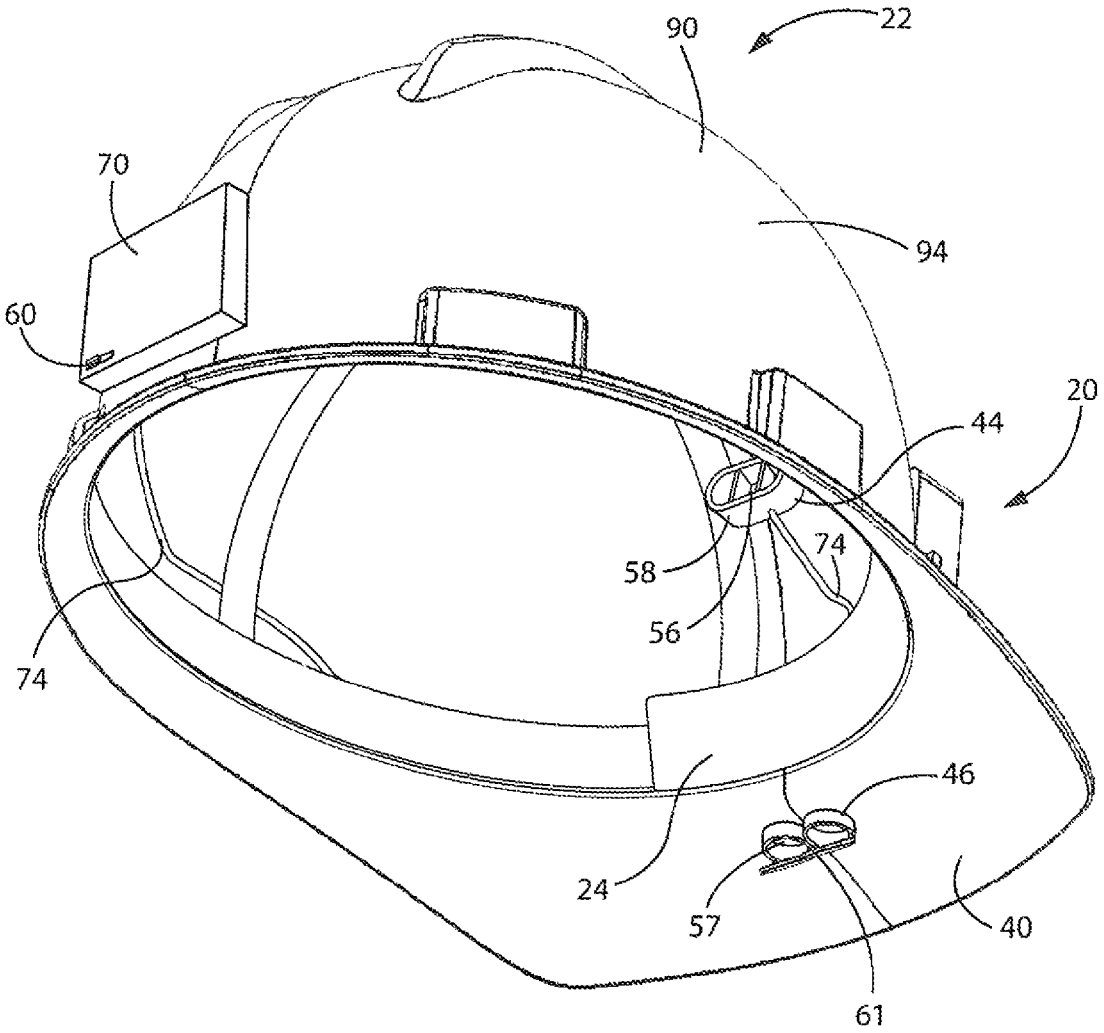
FIG. 2 is a bottom, side perspective view of the fan arrangement with multiple outlets installed on a hard hat as seen in FIG. 1.
Figure 3:
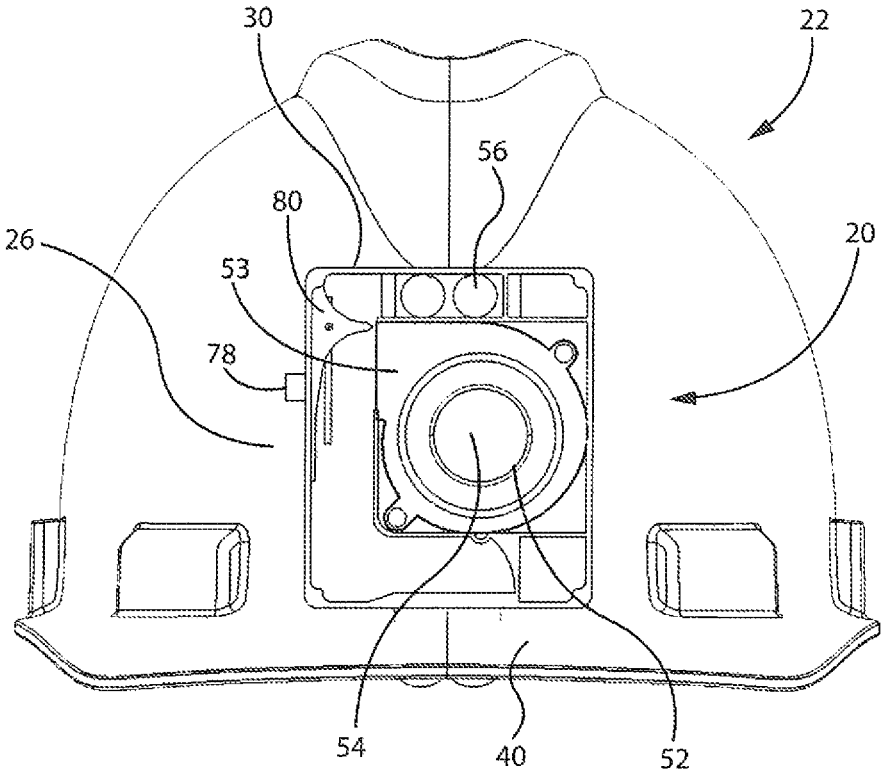
FIG. 3 is a front elevation view of the fan arrangement with multiple outlets installed on a hard hat as seen in FIG. 1, with the front panel of the fan arrangement removed to expose the interior of the fan arrangement.
Figure 4:
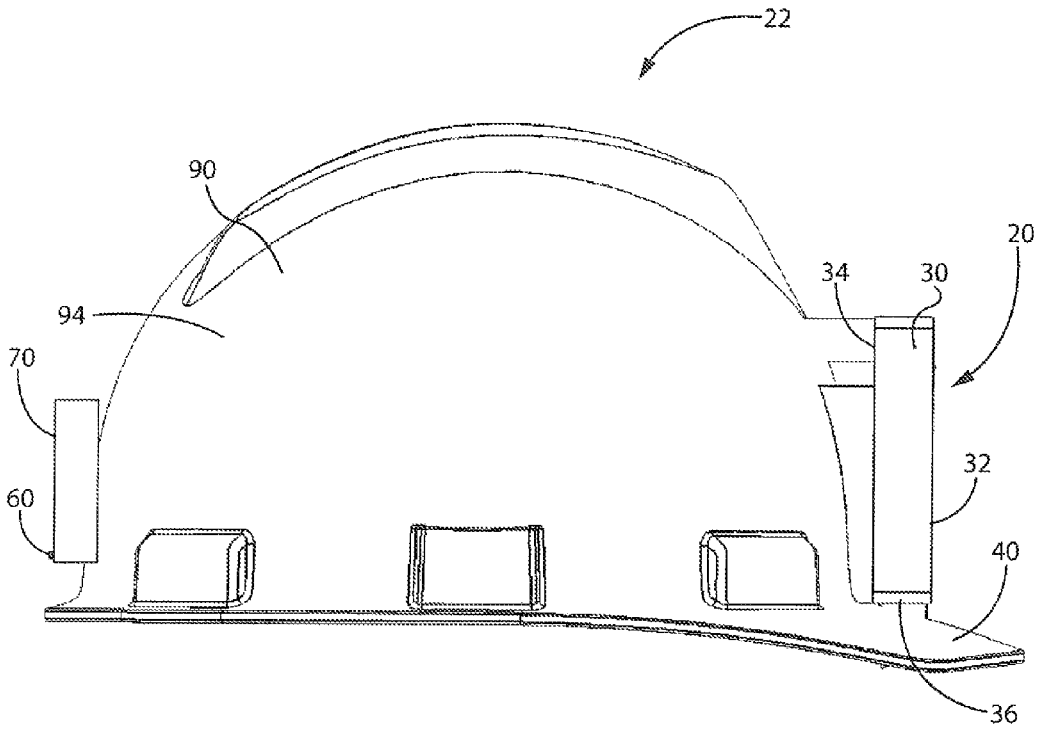
FIG. 4 is a side elevation view of the fan arrangement with multiple outlets installed on a hard hat as seen in FIG. 1.
Figure 5:
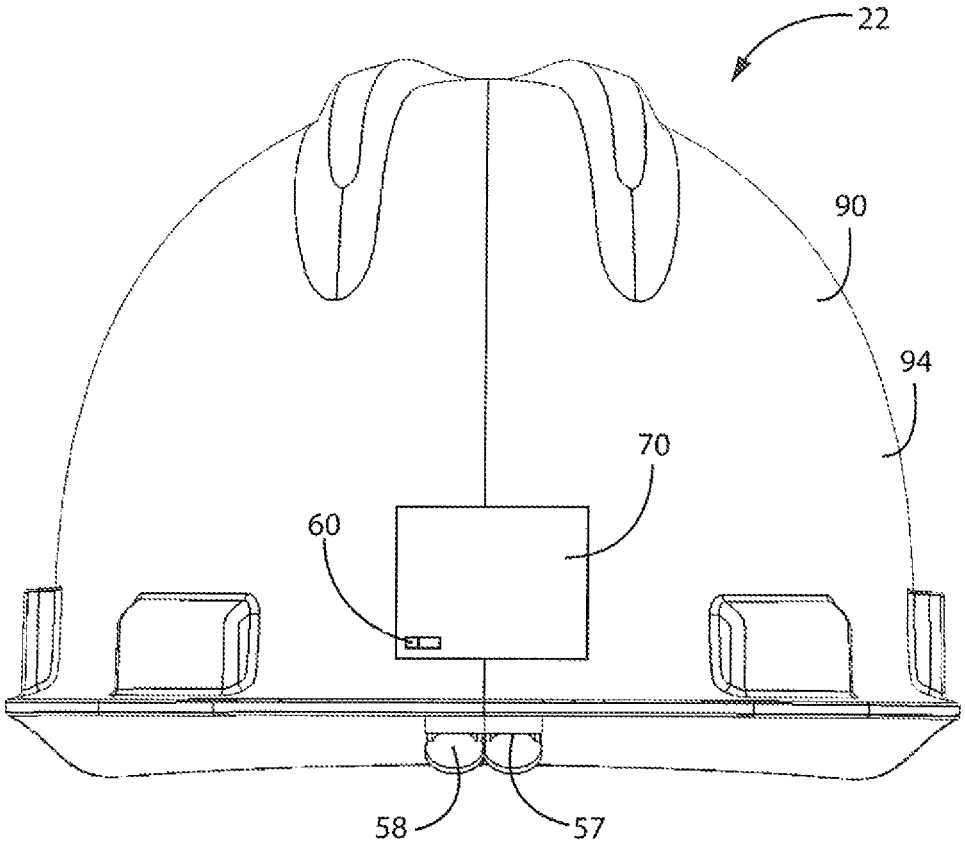
FIG. 5 is a rear elevation view of the fan arrangement with multiple outlets installed on a hard hat as seen in FIG. 1.
Figure 6:
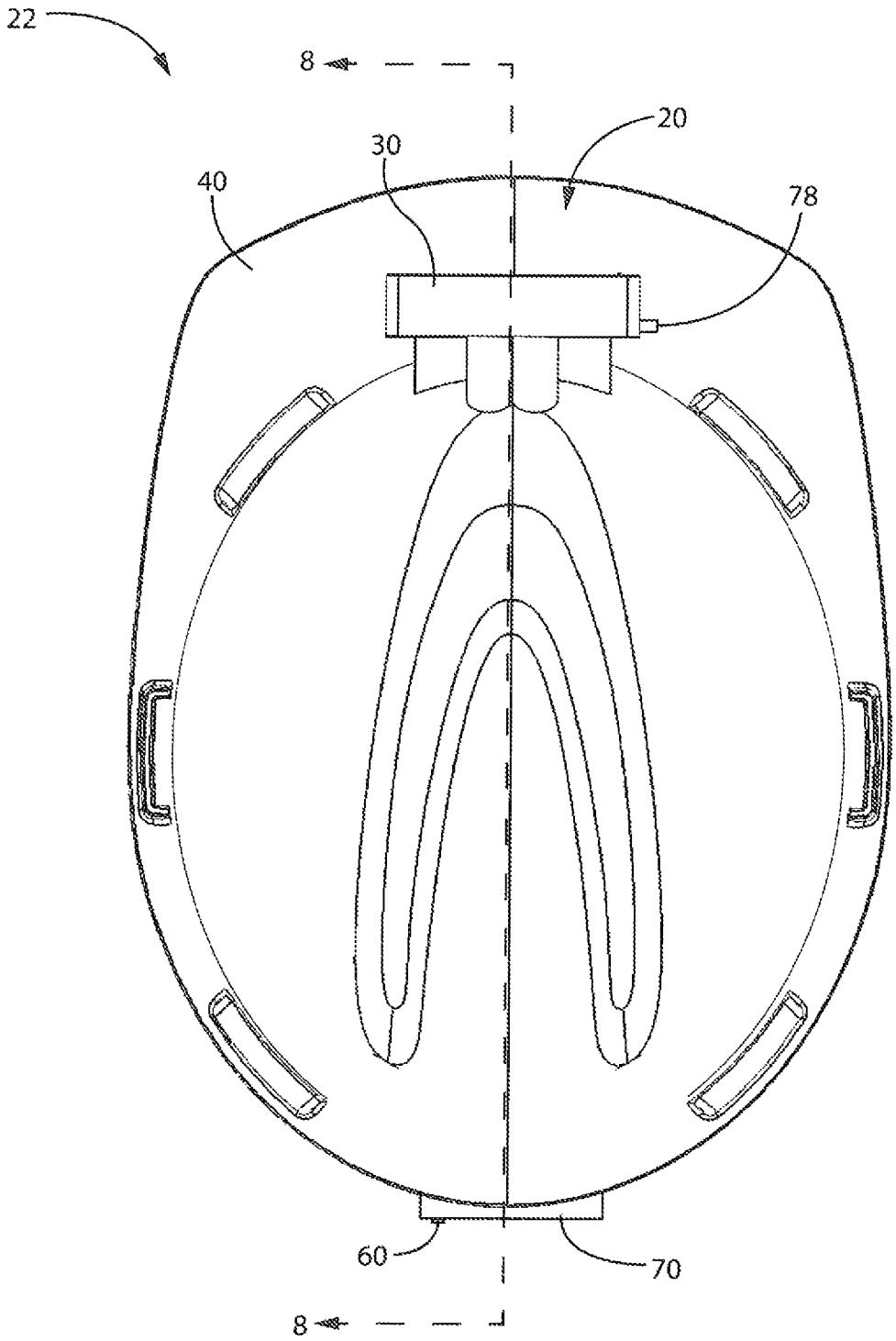
FIG. 6 is a top plan view of the fan arrangement with multiple outlets installed on a hard hat as seen in FIG. 1.
Figure 7:
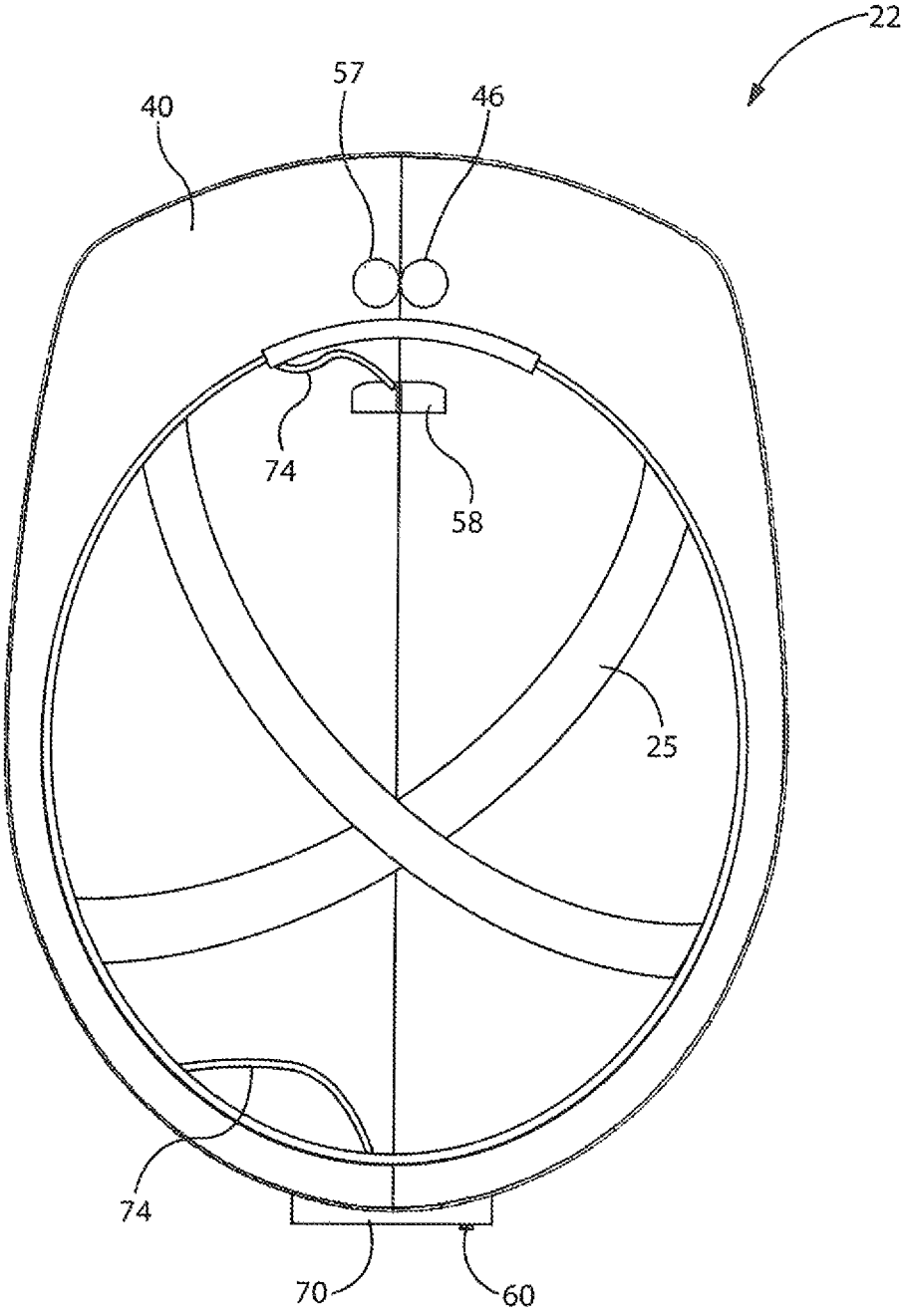
FIG. 7 is a bottom plan view of the fan arrangement with multiple outlets installed on a hard hat as seen in FIG. 1.
Figure 8:
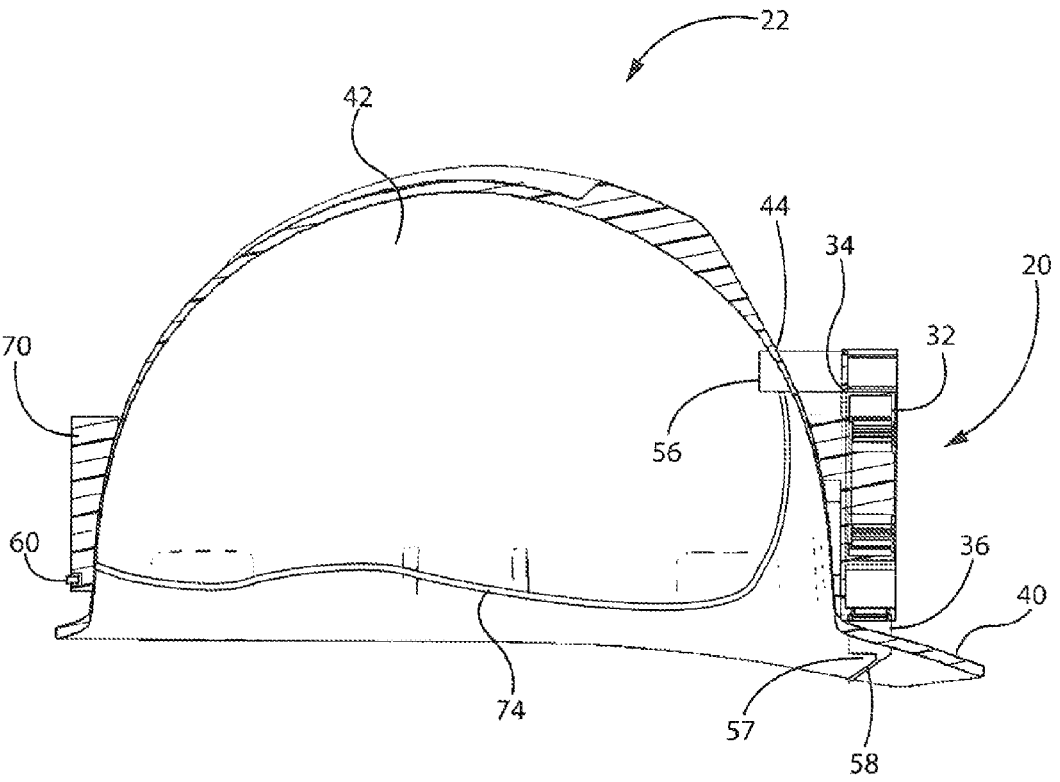
FIG. 8 is a cross-sectional view of the fan arrangement with multiple outlets installed on a hard hat, taken at line 8-8 of FIG. 6.
Figure 9:
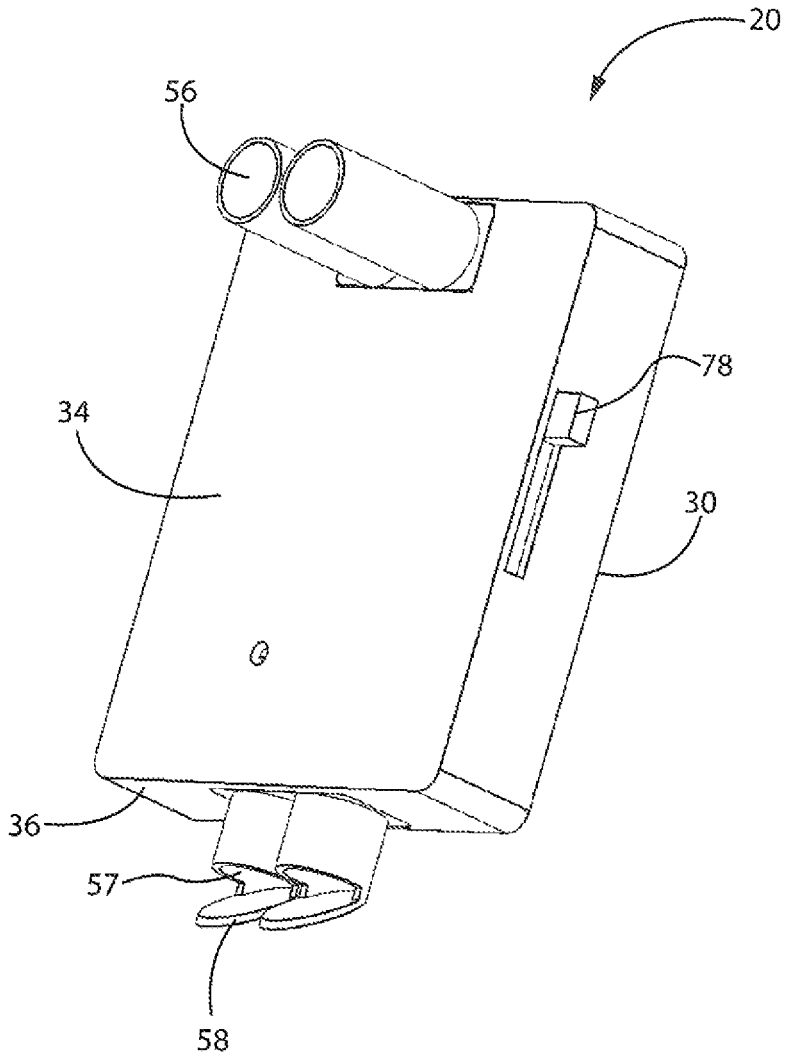
FIG. 9 is a back perspective view of the fan arrangement with multiple outlets as in FIG. 1.

Referring now to FIGS. 1-9, a first embodiment of a fan arrangement 20 consists of a housing 30 that may be made of durable, but lightweight material. For instance, in one embodiment, the housing 30 may be made of a hard plastic. In the illustrated embodiment, the housing 30 is of a generally rectangular shape, and has a front side 32, a back side 34, and a bottom side 36. The front side. 32 has an air intake section 50 that allows air to be drawn into the housing 30 by a fan 52. The fan 52 is located within the housing 30, and is operated by a small motor 54. On the back side 34 of the housing 30 is an outlet 56 through which the air is pushed out of the housing through the exit 53 of the fan 52. In the illustrated embodiment, the outlet 56 has a diffuser 58 which has several grooves that function to distribute the air in a variety of directions. The grooves 59 of the diffuser 58 help to ensure that air is distributed laterally along the interior of the hard hat 22. Other configurations of diffusers may also be used to distribute the air about different planes and in different directions.

Still referring to FIGS. 1-9, the fan arrangement 20 may have additional outlets in addition to the first outlet 56 to increase air movement and comfort. For instance, in addition to the first outlet 56 located on the back side 34 of the housing 30, a second outlet 57 can be located on the bottom side 36 of the housing 30. Like the first outlet 56, the second outlet 57 can have a diffuser 61 such that air is not distributed in a single line, but rather is distributed laterally. In configurations with multiple outlets, a diverter 78 can be included on the side of the housing 30 that allows the user to control the amount of air that goes to the first outlet 56 and the second outlet 57. The diverter 78 is attached to an air diverting slider valve 80 located downstream of the exit 53 of the fan 52 such that air can be diverted towards either outlet 56 or outlet 57. This allows the user to divert all air to the first outlet 56, and thus to the interior of the hard hat; to divert all air to the second outlet 57, and thus to his or her face; or a combination of both.

To install the fan arrangement 20 of the first embodiment, a first opening 44 is formed into the front face 26 of the hard hat 22. The outlet 56 of the fan arrangement 20 can securely fit into the opening 44 such that no additional tools or fasteners are required. A second opening 46 is formed along the brim 40 of the hard hat 22. The second outlet 57 of the fan arrangement 20 can be secured into the second opening 46.

The fan arrangement of the first embodiment 20 can be powered by a number of different power sources. For instance, the fan arrangement may have a power source within the housing 30. Alternatively, the power source may be a stand-alone unit 70 attached to the fan arrangement 20 by wires 74. A standard battery or a rechargeable battery may be used. Alternatively, the fan arrangement 20 can be powered through a solar plate (not shown). Such a configuration will be especially appealing when the hard hat is being used in an outdoor environment. The stand-alone power source 70 can be mounted anywhere on the hard hat 22. In the illustrated embodiment, the stand-alone power source 70 is mounted on the rear of the hard hat 22. Alternatively, the stand-alone power source 70 could be mounted on the head band 24 of the hard hat 22.

Once the fan arrangement 20 is installed to the hard hat 22 and connected to the power source 70, it is ready for use. On the side of the power source 70 is an on/off switch 60. Once turned on, the motor 54 of the fan arrangement 20 will begin to run, which propels the fan 52. This fan 52 draws air through the intake 50 and out the fan exit 53 where it moves among the housing 30. Some of the air may continue out through the rear outlet 56. This configuration provides increased air movement along the crown 42 of the hard hat 22 such that the top of the user's head is cooled. Additionally, a portion of the air flow may be directed to the second outlet 57, which provides increased air movement along the user's face. A user can adjust the diverter 78 to control the proportion of air that is directed to the first outlet 56 and the second outlet 57. Additional outlets may be used as would be apparent to one skilled in the art.

Figure 10:
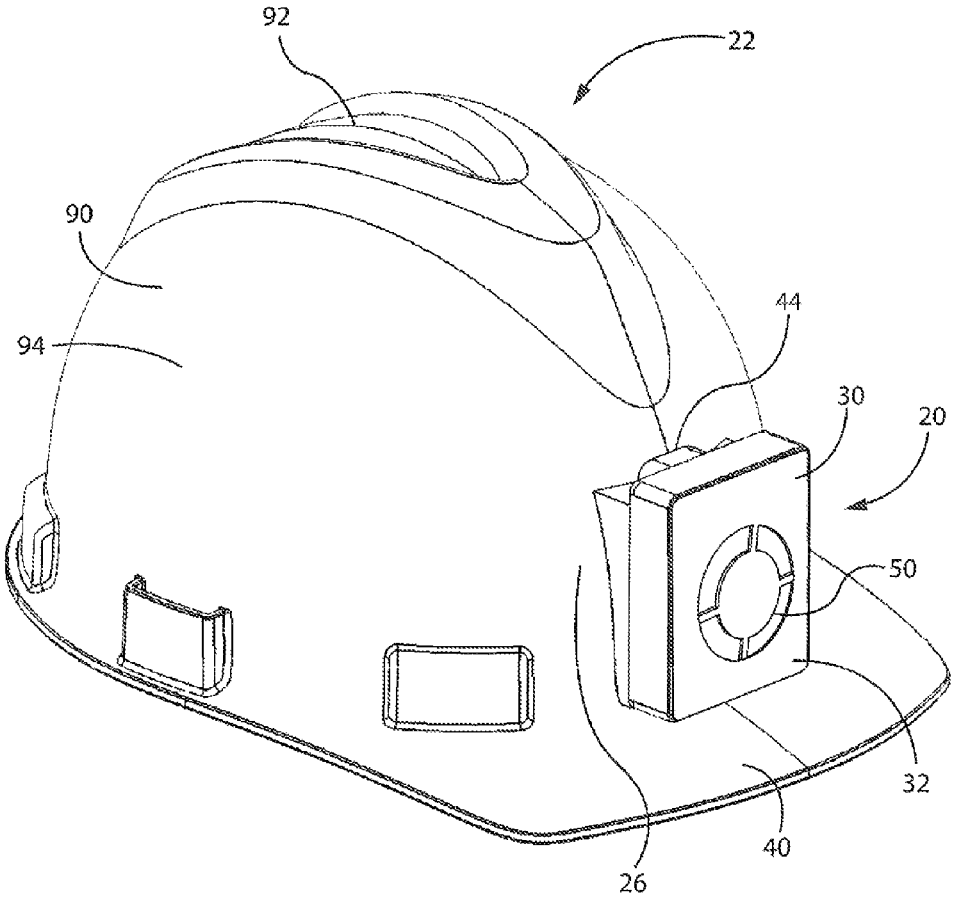
FIG. 10 is a top side perspective view of a fan arrangement with a single outlet installed on a hard hat in accordance with a second embodiment of the present invention.
Figure 11:
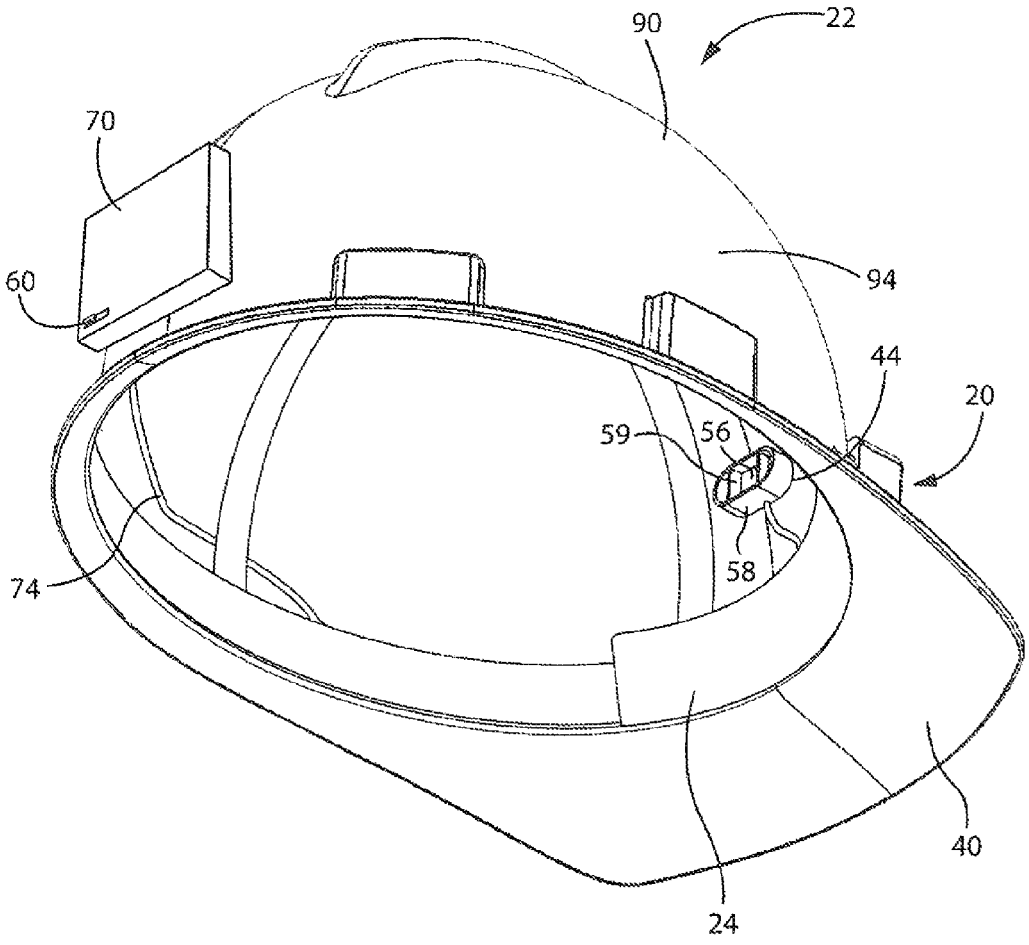
FIG. 11 is a bottom side perspective view of the fan arrangement with a single outlet installed on a hard hat as seen in FIG. 10.
Figure 12:
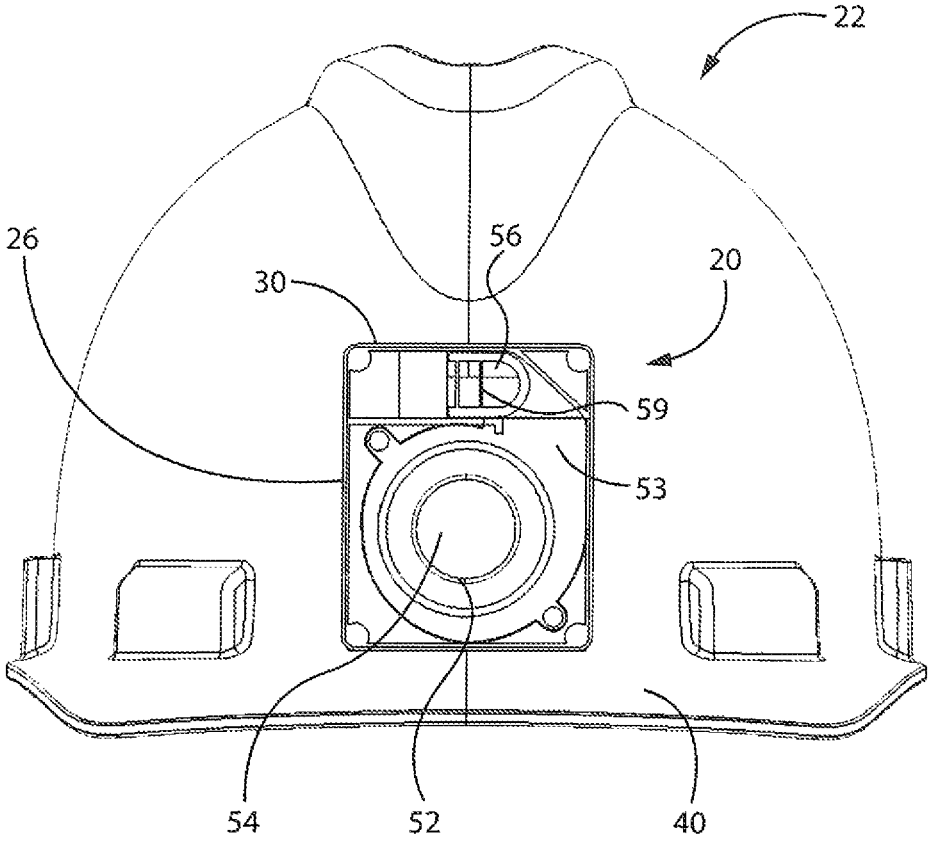
FIG. 12 is a front elevation view of the fan arrangement with a single outlet installed on a hard hat as seen in FIG. 10, with the front panel of the fan arrangement removed to expose the interior of the fan arrangement.
Figure 13:
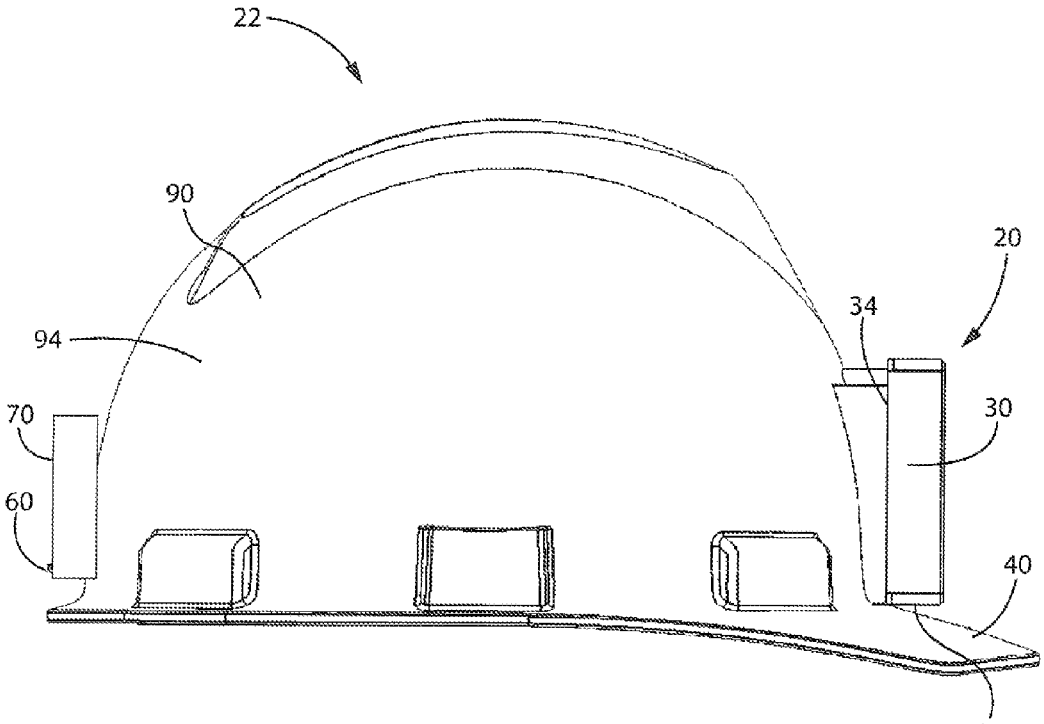
FIG. 13 is a side elevation view of the fan arrangement with a single outlet installed on a hard hat as seen in FIG. 10.
Figure 14:
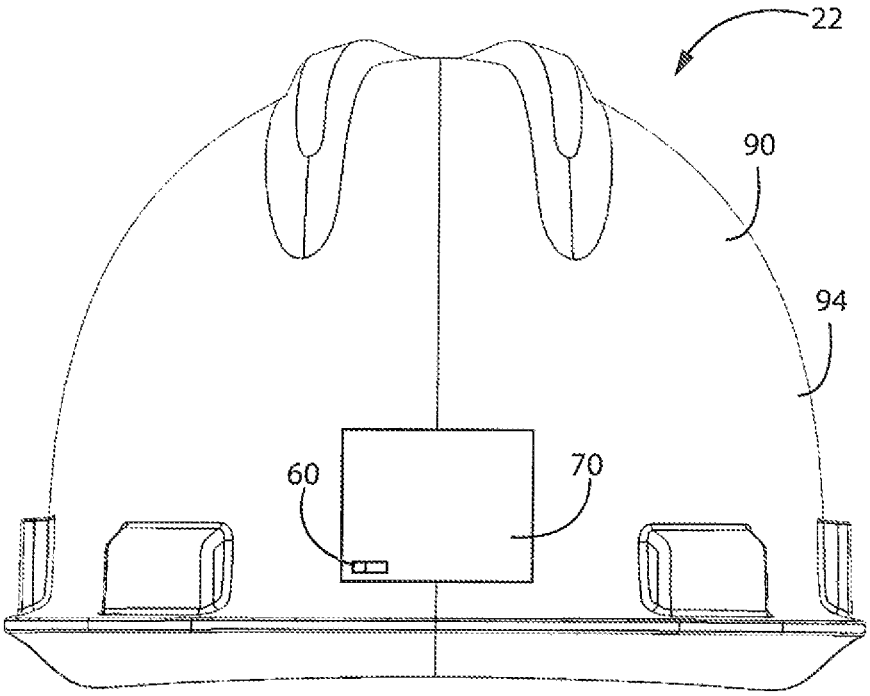
FIG. 14 is a rear elevation view of the fan arrangement with a single outlet installed on a hard hat as seen in FIG. 10.
Figure 15:
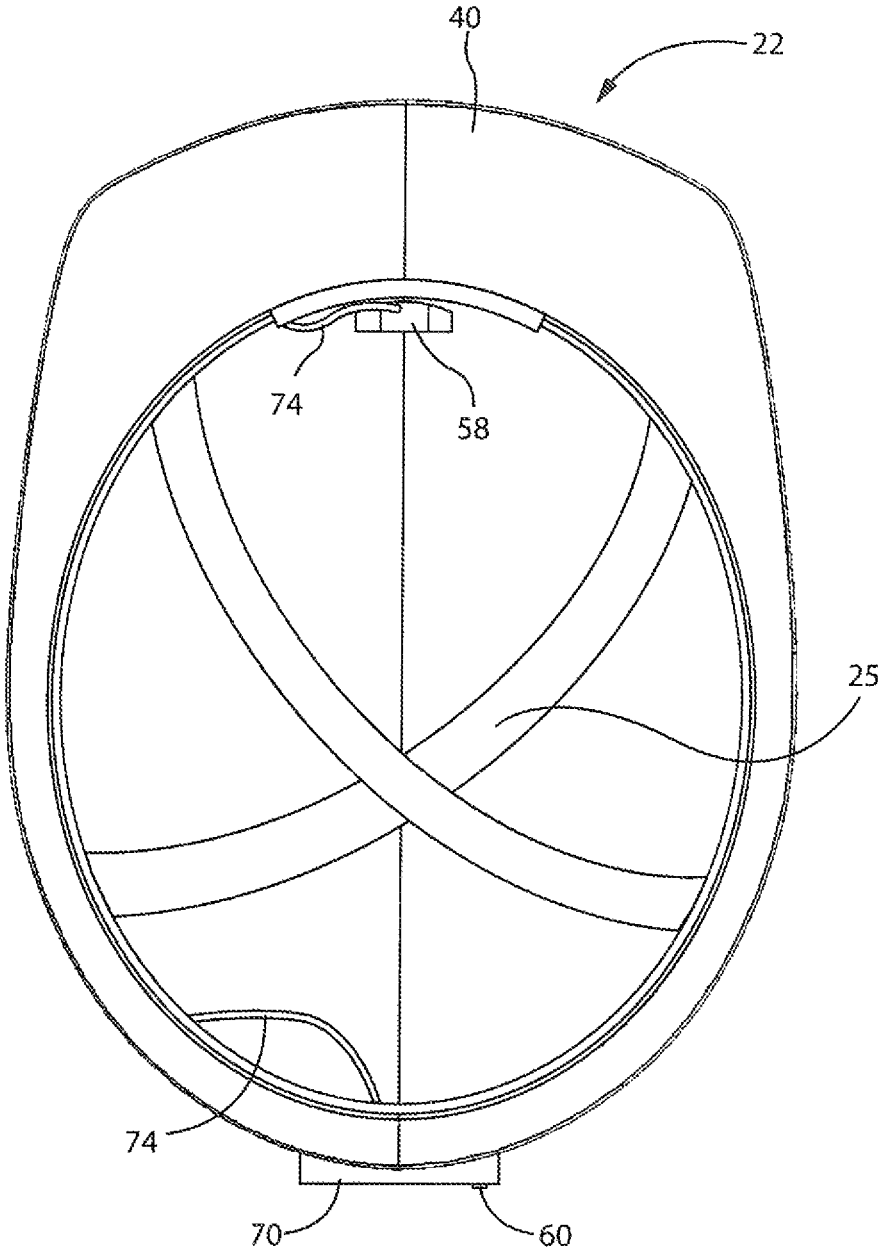
FIG. 15 is a bottom plan view of the fan arrangement with a single outlet installed on a hard hat as seen in FIG. 10.
Figure 16:
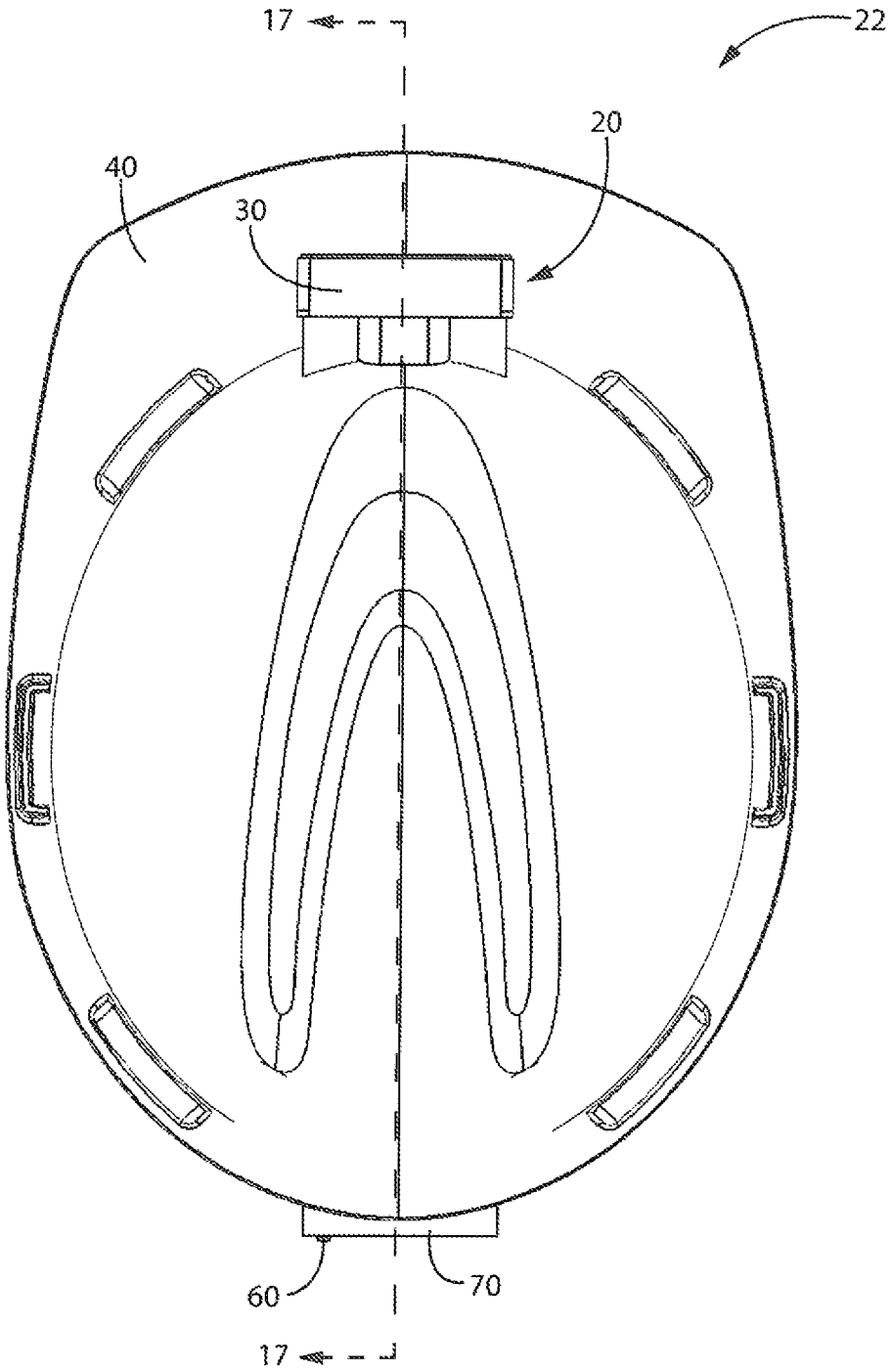
FIG. 16 is a top plan view of the fan arrangement with a single outlet installed on a hard hat as seen in FIG. 10.
Figure 17:
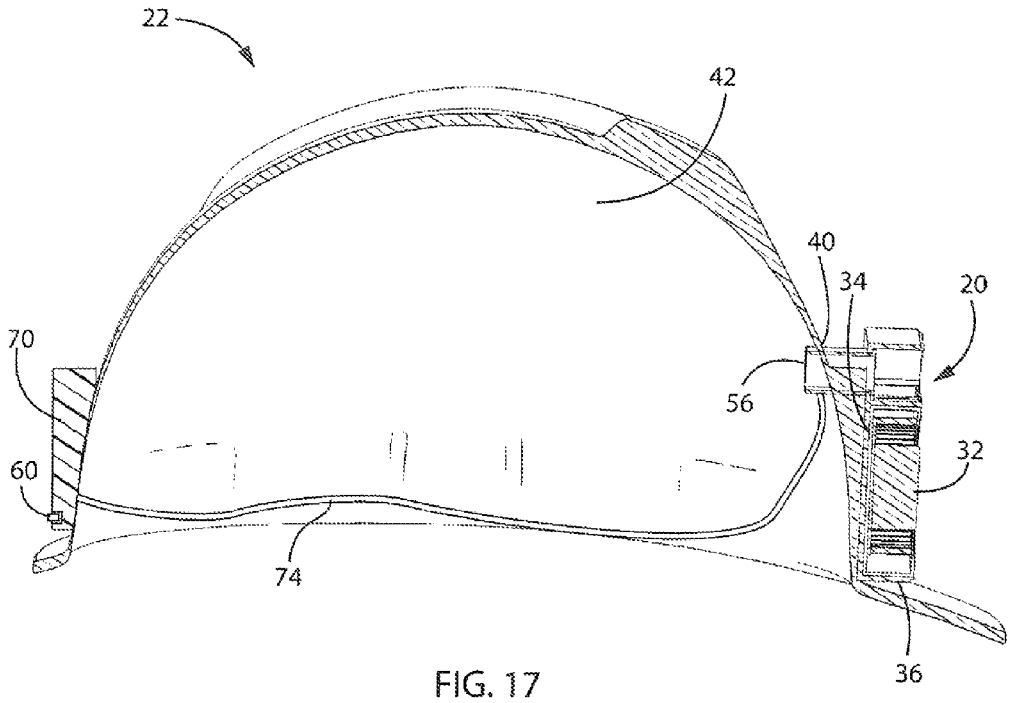
FIG. 17 is a cross-sectional view of the fan arrangement with a single outlet installed on a hard hat, taken at line 17-17 of FIG. 16.
Figure 18:
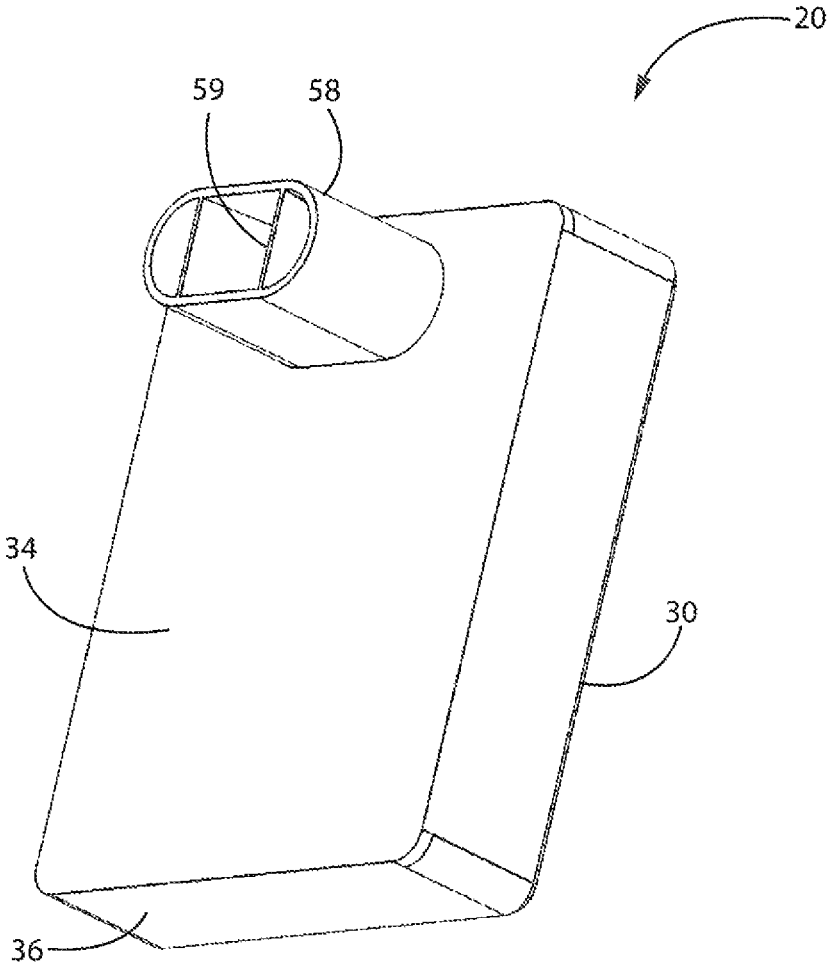
FIG. 18 is a back perspective view of the fan arrangement with a single outlet.

Referring now to FIGS. 10-18, a second embodiment of the present invention features a fan assembly 20*a* with only one outlet 56*a*. In this embodiment, the fan arrangement 20*a* consists of a housing 30*a* that may be made of durable, but lightweight material. For instance, the housing 30*a* may be made of a hard plastic. In the illustrated embodiment, the housing 30*a* is of a generally rectangular shape, and has a front side 32*a*, a back side 34*a*, and a bottom side 36*a*. The front side 32*a* has an air intake section 50*a* that allows air to be drawn into the housing 30*a* by a fan 52*a*. The lint 52*a* is located within the housing 30*a*, and is operated by a small motor 54*a*. On the back side 34*a* of the housing 30*a* is an outlet 56*a* through which the air is pushed out of the housing through the exit 53*a* of the fan 52*a*. In the illustrated embodiment, the outlet 56*a* has a diffuser 58*a* which has several grooves that function to distribute the air in a variety of directions. The grooves 59*a* of the diffuser 58*a* help to ensure that air is distributed laterally along the interior of the hard hat 22*a*. Other configurations of diffusers may also be used to distribute the air about different planes and in different directions.

To install the fan arrangement 20*a*, a first opening 44*a* is formed into the front face 26*a* of the hard hat 22*a*. The outlet 56*a* of the fan arrangement 20*a* can securely fit into the opening 44*a* such that no additional tools or fasteners are required. The fan arrangement of the second embodiment 20*a* can be powered by a number of different power sources. For instance, the fan arrangement may have a power source within the housing 30*a*. Alternatively, the power source may be a stand-alone unit 70*a* attached to the fan arrangement 20*a* by wires 74*a*. A standard battery or a rechargeable battery may be used. Alternatively, the fan arrangement 20*a* can be powered through a solar plate (not shown). The stand-alone power source 70*a* can be mounted anywhere on the hard hat 22*a*. In the illustrated embodiment, the stand-alone power source 70*a* is mounted on the rear of the hard hat 22*a*. Alternatively, the stand-alone power source 70*a* could be mounted on the head band 24*a* of the hard hat 22*a*.

Once the fan arrangement 20*a* of the second embodiment is installed to the hard hat 22*a* and connected to the power source 70*a*, it is ready for use. On the side of the power source 70*a* is an on/off switch 60*a*. Once turned on, the motor 54*a* of the fan arrangement 20*a* will begin to run, which propels the fan 52*a*. This fan 52*a* draws air through the intake 50*a* and out the fan exit 53*a* where it moves among the housing 30*a*. The air then continues out through the rear outlet 56*a*. This configuration provides increased air movement along the crown 42*a* of the hard hat 22*a* such that the top of the user's head is cooled.

Various alternatives and embodiments are contemplated as being within the scope of the following claims particularly pointing out and distinctly claiming the subject matter regarded as the invention.

I claim:

1. A hard hat adapted to be worn by a user, comprising:

a shell defining an interior and an exterior, wherein the shell defines an upwardly facing top and a laterally facing external side portion; and a fan arrangement configured to circulate air through the interior of the shell, wherein the fan arrangement comprises a fan housing having an intake and outlet, wherein the fan housing intake is located exteriorly of the shell, wherein the outlet extends through an opening in the shell and wherein the outlet is received within the opening, wherein the outlet and the opening are configured such that engagement of the outlet within the opening functions to attach the fan housing to the hard hat, and wherein the outlet extends past an interior surface defined by the shell.

2. The hard hat of claim 1 further comprising a brim along a bottom edge of the laterally facing external side portion of the shell, wherein the brim extends outwardly away from the interior.

3. The hard hat of claim 2, wherein the fan arrangement is located above the brim.

4. The hard hat of claim 2, wherein the fan arrangement has a first outlet and a second outlet.

5. The hard hat of claim 1, wherein the fan arrangement is powered by a stand-alone power supply.

6. The hard hat of claim 5, wherein the fan arrangement is secured to a front portion of the laterally facing external side portion and the stand-alone power supply is secured to a rear portion of the laterally facing external side portion.

7. A hard hat adapted to be worn by a user, comprising:

a shell defining an interior and an exterior, wherein the shell defines an upwardly facing top and a laterally facing external side portion; and a fan arrangement configured to circulate air through the interior of the shell, wherein the fan arrangement comprises a fan housing having an intake, a first outlet, and a second outlet, wherein the fan arrangement contains a diverter that adjustably controls the amount of air movement to the first outlet and the amount of air movement to the second outlet.

8. The hard hat of claim 7, wherein the first outlet circulates air through the laterally facing external side portion toward the interior of the shell and the second outlet circulates air through the brim.

9. The hard hat of claim 8, wherein the diverter further comprises an air diverting slider valve.

10. The hard hat of claim 9, wherein the air diverting slider valve is configured to slide between a first position in which all of the air is diverted to the first outlet and a second position in which all of the air is diverted to the second outlet.

11. A method of providing an air circulation feature to a hard hat, wherein the hard hat includes a shell defining an interior and an exterior and defines an upwardly facing top and a laterally facing external side portion, comprising the steps of:

forming an opening in the laterally facing external side portion of the shell; and securing a fan arrangement to the shell, wherein the fan arrangement includes an intake and an outlet, and wherein the step of securing the fan arrangement to the shell is carried out by inserting the outlet of the fan arrangement into the opening, wherein the fan arrangement is secured within the opening such that the intake of the fan arrangement is located exteriorly of the shell and the outlet of the fan arrangement extends through the opening into the interior of the shell such that operation of the fan arrangement forces air into the interior of the shell.

12. The method of claim 11, wherein the shell has a brim that extends outwardly away from the interior along a bottom edge of the laterally facing external side portion of the shell.

13. The method of claim 12, wherein the step of securing the fan arrangement to the shell is carried out such that the fan arrangement is located above the brim.

14. The method of claim 12, wherein the opening in the shell is located above the brim.

15. The method of claim 12, further comprising the step of forming a second opening at the brim.

16. The method of claim 15, wherein the fan arrangement has a first outlet and a second outlet, wherein the fan arrangement is secured to the shell such that the first outlet is in communication with the first-mentioned opening in the shell and the second outlet is in communication with the second opening.

17. The method of claim 16, wherein the fan arrangement contains an adjustable diverter that controls the amount of air movement to the first outlet and controls the amount of air movement to the second outlet.

18. The method of claim 16, wherein the first outlet circulates air through the laterally facing external side portion toward the interior of the shell and the second outlet circulates air through the brim.

19. The method of claim 11, further comprising the steps of securing a power supply to the shell; and connecting the power supply to the fan arrangement.

20. The method of claim 19, wherein the fan arrangement is secured to a front portion of the laterally facing external side portion and the power supply is secured to a rear portion of the laterally facing external side portion.

* * * * *